US007040516B2

(12) United States Patent
Devrick et al.

(10) Patent No.: US 7,040,516 B2
(45) Date of Patent: May 9, 2006

(54) SHIRT PRESSING DEVICE WITH IMPROVED CUFF CLAMPS

(75) Inventors: Charles E. Devrick, Tampa, FL (US); John Wagner, Brooksville, FL (US)

(73) Assignee: Unipress Corporation, Tampa, FL (US)

( * ) Notice: Subject to any disclaimer, the term of this patent is extended or adjusted under 35 U.S.C. 154(b) by 185 days.

(21) Appl. No.: 10/790,528

(22) Filed: Mar. 1, 2004

(65) Prior Publication Data

US 2005/0029316 A1 Feb. 10, 2005

Related U.S. Application Data

(60) Provisional application No. 60/492,695, filed on Aug. 4, 2003.

(51) Int. Cl.
*D06F 71/28* (2006.01)

(52) U.S. Cl. ..... 223/73

(58) Field of Classification Search ..... 223/52.1, 223/52.5, 66–74; 38/12, 14, 64, 66
See application file for complete search history.

(56) References Cited

U.S. PATENT DOCUMENTS

| | | | | |
|---|---|---|---|---|
| 3,471,067 | A | 10/1969 | Stewart | |
| 3,568,900 | A * | 3/1971 | Paris | 223/70 |
| 6,186,377 | B1 * | 2/2001 | McCormick et al. | 223/68 |
| 6,401,992 | B1 | 6/2002 | Harrod et al. | |
| 6,758,377 | B1 * | 7/2004 | Uchikoshi | 223/73 |
| 6,813,852 | B1 * | 11/2004 | Uchikoshi | 38/66 |

* cited by examiner

*Primary Examiner*—Ismael Izaguirre
(74) *Attorney, Agent, or Firm*—Holland & Knight LLP

(57) ABSTRACT

An improved shirt pressing device for gripping both short and long-sleeved shirts. A buck having a pair of retractable arms for receiving a shirt is mounted on a base. A sleeve gripping member is provided on each retractable arm to grip the sleeve of the shirt to be pressed. Each sleeve gripping member includes a pair of clamping members for holding the cuff of a long-sleeved shirt against a cuff mount. A pair of sleeve engagement bars attached to the clamping members are adapted to grip the inside of the sleeve of a short-sleeved shirt. Thus, the retractable arms are configured to receive and hold the sleeves of both short and long-sleeved shirts.

2 Claims, 5 Drawing Sheets

SHIRT PRESSING DEVICE WITH IMPROVED CUFF CLAMPS

CROSS REFERENCE TO RELATED APPLICATIONS

This application is a utility application based upon and claiming priority of provisional application No. 60/492,695, filed Aug. 4, 2003, the disclosure of which is incorporated by reference herein.

FIELD OF THE INVENTION

This invention relates to a method and apparatus used to press clothing articles. More particularly, the present invention relates to an automated double-BUCK pressing device that has an improved assembly for mechanically gripping the sleeves of both short and long-sleeved garments.

DESCRIPTION OF THE BACKGROUND ART

Shirt pressing machines are known in the industry and generally comprise a shirt supporting body, or buck, which is movable on a track or turntable between a dressing station and a pressing station, where the front and back of the shirt is contacted by heated pressing plates for the purpose of removing wrinkles and, at the same time, drying the shirt.

Typically, at the pressing station, compressed air is admitted into the interior of the buck and exits through a plurality of openings formed in the inflatable buck body, so as to facilitate drying and pressing of the garment. U.S. Pat. No. 3,471,067 provides for sleeve extenders to move the sleeves of the shirt laterally outward from the inflatable buck in response to an actuation of air cylinders. Specifically, when a long sleeve shirt is positioned on a buck, the sleeve extenders pull on the long sleeves to remove the wrinkles from the long sleeves as the arms of the piston cylinders are moved to an expanded position.

The prior art teaches that the area of the sleeve which contacts the cuff is held by a clamp and the sleeve is extended in slight tension away from the shirt body. Steam and heated pressurized air enter the sleeve through the opening at the shirt body. All other openings of the sleeve must be closed to allow the pressurized, heated air to inflate the sleeve to its natural form for finishing.

U.S. Pat. No. 6,401,992 teaches an apparatus and method where a long sleeve garment is finished through the use of a clip positioned at an upper end of each of the elongated arms. The clips are formed with resiliently urged fingers and adapted to receive an area of the long sleeve garment and form an obstruction for the flow of heated air and steam therethrough during a finishing operation. In the alternative, a manually operated rotatable clamp is provided along the length of each of the elongated arms to finish a short sleeve garment on the same pressing apparatus. This manually operated rotatable clamp has to be rotated in or out of position by the operator depending on the sleeve length of the shirt to be pressed.

Therefore, there exists a need in the art to improve and preserve the quality of a finished sleeve (long or short) of a garment and to improve operator efficiency while providing a sleeve clamping mechanism for a shirt pressing machine which easily adapts to varied sleeve lengths.

It is another object of the present invention to provide an improved apparatus for pressing garments that can be incorporated into currently existing shirt pressing machines without extensive modifications or expense.

Nothing in the prior art provides the benefits attendant with the present invention.

Therefore, it is an object of the present invention to provide an improvement which overcomes the inadequacies of the prior art devices and which is a significant contribution to the advancement of the shirt pressing art.

It is a further object of the present invention to increase the efficiency, simplicity and safety of garment finishing machines while reducing the cost through reduced equipment.

Another object of the present invention is to press the front and back of a garment while concurrently finishing both short and long sleeves.

It is a further object of the present invention to provide a sleeve gripping member mounted on the retractable arms of a pressing apparatus whereby both long sleeve garments and short sleeve garments can be routinely pressed on the pressing apparatus.

Another object of the present invention is to provide retractable arms that are attached to pneumatic cylinders on the pressing system whereby the pair of retractable arms can be selectively extended to accommodate garments of different sizes and sleeve lengths.

Yet another object of the present invention is to provide a cuff mounting member and a pair of clamping members along each of the retractable arms of a pressing apparatus wherein the clamping members are adapted to receive and hold long garment sleeves against the cuff mounting member.

It is a further object of the present invention to provide a tear drop shaped cuff mounting member to properly hold the cuff of the long sleeve garment.

Another object of the present invention is to provide a fabric covered tear drop shaped cuff mounting member to stop steam and air from escaping out of the end of the long sleeve of the garment.

Yet another object of the present invention is to provide a soft foam cover for each cuff plate to eliminate marks in the cuff during the pressing of the long sleeve of the garment.

It is a further object of the present invention to provide pneumatically operated clamping members along each of the retractable arms of a pressing apparatus.

Another object of the present invention is to provide a pair of sleeve engagement bars along each of the retractable arms of a pressing apparatus wherein the sleeve engagement bars are adapted to receive and hold short garment sleeves.

Yet another object of the present invention is to provide pneumatically operated sleeve engagement bars along each of the retractable arms of a pressing apparatus.

It is yet another object of the present invention is to provide at least one pneumatic valve to operate the pair of retractable arms, the clamping members and the sleeve engagement bars of a pressing apparatus.

It is a further object of the present invention to provide sleeve engagement bars having curved ends to help insure that the sleeve engagement bars do not snag the sleeve of the shirt being pressed.

Another object of the present invention is to provide sleeve engagement bars having textured tubes to prevent slippage of the sleeve while the operator places the sleeve on the sleeve engagement bars for proper alignment.

Yet another object of the present invention is to provide an improved pressing apparatus for pressing a garment, the apparatus comprising, a buck for receiving the garment to be pressed; a collar mount for receiving a collar of the garment to be pressed; a pair of retractable arms pneumatically mounted on a base of the pressing apparatus such that the arms can be extended to accommodate different sizes of garments and sleeve lengths; a cuff mounting member positioned on each of the retractable arms for receiving and mounting the long sleeves of the garment to be pressed; a pair of clamping members operably positioned with respect to the cuff mounting member on each of the retractable arms for holding long sleeves of the garment to be pressed; and a pair of sleeve engagement bars positioned on each of the retractable arms for receiving and holding short sleeves of the garment to be pressed, the sleeve engagement bars moving closer to one another for mounting and releasing the short sleeves of the garment to be pressed, the sleeve engagement bars moving apart from one another for holding the short sleeves of the garment to be pressed.

Still yet another object of the present invention is to provide a mounting device for mounting a garment on a pressing system prior to performing a pressing operation on the garment, the device comprising, a buck for receiving the garment to be pressed; a pair of retractable arms mounted on a base of the pressing system such that the arms can be moved with respect to the buck; and a sleeve gripping member mounted on each of the retractable arms whereby the mounting device may be used to press both long sleeve garments and short sleeve garments.

Another object of the present invention is to provide a method for finishing a pair of sleeves on a garment comprising, providing a buck for receiving the garment to be pressed; providing a pair of retractable arms positioned on opposing sides of the buck; providing a pair of sleeve gripping members mounted on each of the retractable arms; mounting the garment to be pressed onto the buck; mounting an end of each long sleeve of a long sleeve garment onto the sleeve gripping members; gripping the end of each long sleeve on each of the sleeve gripping members; extending the pair of retractable arms away from the buck; flowing heated air and steam through the long sleeve garment during a finishing operation; releasing the end of each long sleeve from each of the sleeve gripping members to unload the long sleeve garment; mounting an end of each short sleeve of a short sleeve garment onto the sleeve gripping members; gripping the end of each short sleeve on each of the sleeve gripping members; extending the pair of retractable arms away from the buck; flowing heated air and steam through the short sleeve garment during the finishing operation; and releasing the end of each short sleeve from each of the sleeve gripping members to unload the short sleeve garment.

It is yet another object of the present invention to provide a method for finishing a pair of sleeves on a garment comprising, providing a buck for receiving the garment to be pressed; providing a pair of retractable arms positioned on opposing sides of the buck; providing a pair of sleeve gripping members mounted on each of the retractable arms; mounting the garment to be pressed onto the buck; mounting an end of each long sleeve of a long sleeve garment onto a cuff mounting member positioned on each of the sleeve gripping members; contracting a pair of clamping members positioned on each of the sleeve gripping members against the end of each long sleeve; extending the pair of retractable arms away from the buck; flowing heated air and steam through the long sleeve garment during a finishing operation; extending the pair of clamping members away from the end of each long sleeve to unload the long sleeve garment; mounting an end of each short sleeve of a short sleeve garment onto a pair of sleeve engagement bars positioned on each of the sleeve gripping members; expanding each of the pair of sleeve engagement bars within the end of each short sleeve; extending the pair of retractable arms away from the buck; flowing heated air and steam through the short sleeve garment during the finishing operation; and contracting the pair of sleeve engagement bars away from the end of each short sleeve to unload the short sleeve garment.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

A feature of the present invention is to press the front and back of a garment while concurrently finishing both short and long sleeves.

A further feature of the present invention to provide a sleeve gripping member mounted on the retractable arms of a pressing apparatus whereby both long sleeve garments and short sleeve garments can be routinely pressed on the pressing apparatus.

Another feature of the present invention is to provide retractable arms that are attached to pneumatic cylinders on the pressing system whereby the pair of retractable arms can be selectively extended to accommodate garments of different sizes and sleeve lengths.

Yet another feature of the present invention is to provide a cuff mounting member and a pair of clamping members along each of the retractable arms of a pressing apparatus wherein the clamping members are adapted to receive and hold long garment sleeves against the cuff mounting member.

It is a further feature of the present invention to provide a tear drop shaped cuff mounting member to properly hold the cuff of the long sleeve garment.

Another feature of the present invention is to provide a fabric covered tear drop shaped cuff mounting member to stop steam and air from escaping out of the end of the long sleeve of the garment.

Yet another feature of the present invention is to provide a soft foam cover for each cuff plate to eliminate marks in the cuff during the pressing of the long sleeve of the garment.

It is a further feature of the present invention to provide pneumatically operated clamping members along each of the retractable arms of a pressing apparatus.

Another feature of the present invention is to provide a pair of sleeve engagement bars along each of the retractable arms of a pressing apparatus wherein the sleeve engagement bars are adapted to receive and hold short garment sleeves.

Yet another feature of the present invention is to provide pneumatically operated sleeve engagement bars along each of the retractable arms of a pressing apparatus.

It is yet another feature of the present invention is to provide at least one pneumatic valve to operate the pair of retractable arms, the clamping members and the sleeve engagement bars of a pressing apparatus.

It is a further feature of the present invention to provide sleeve engagement bars having curved ends to help insure that the sleeve engagement bars do not snag the sleeve of the shirt being pressed.

Another feature of the present invention is to provide sleeve engagement bars having textured tubes to prevent slippage of the sleeve while the operator places the sleeve on the sleeve engagement bars for proper alignment.

Yet another feature of the present invention is to provide an improved pressing apparatus for pressing a garment of different sizes and varying sleeve lengths. The apparatus comprising a buck for receiving the garment to be pressed, a collar mount for receiving a collar of the garment to be pressed, a pair of retractable arms pneumatically mounted on a base of the pressing apparatus and a cuff mounting member positioned on each of the retractable arms. The retractable arms can be extended to accommodate different sizes of garments and sleeve lengths. The sleeves of a long sleeve garment to be pressed are placed on the cuff mounting member between a pair of clamping members on each of the retractable arms for mounting and holding the long sleeves of the garment to be pressed. In the alternative, the sleeves of a short sleeve garment to be pressed are placed on a pair of sleeve engagement bars that are positioned on each of the retractable arms for receiving and holding short sleeves of the garment to be pressed. The sleeve engagement bars contract towards one another to mount and to release the short sleeves of the garment to be pressed. The sleeve engagement bars move apart from one another to hold the short sleeves of the garment to be pressed during the pressing operation.

Still yet another feature of the present invention is to provide a mounting device for mounting a garment on a pressing system prior to performing a pressing operation on the garment. The mounting device comprising, a buck for receiving the garment to be pressed, a pair of retractable arms mounted on a base of the pressing system, and a sleeve gripping member mounted on each of the retractable arms. The retractable arms can be moved with respect to the buck to accommodate different sizes of garments and sleeve lengths. The mounting device allows the pressing system to press both long sleeve garments and short sleeve garments on the same pressing system in an efficient and safe manner.

Another feature of the present invention is to provide a method for finishing a pair of sleeves on garments of different sizes and sleeve lengths. The method comprising, providing a buck for receiving the garment to be pressed with a pair of retractable arms positioned on opposing sides of the buck. In addition, a pair of sleeve gripping members are provided on each of the retractable arms. The garment to be pressed is mounted onto the buck. An end of each long sleeve of a long sleeve garment is mounted onto the sleeve gripping members. The respective end of each long sleeve is gripped by the respective sleeve gripping member. The pair of retractable arms are extended away from the buck into a finishing position. Heated air and steam flows through the long sleeve garment during the finishing operation. In order to release the garment, the respective end of each long sleeve is released from the respective sleeve gripping member and the long sleeve garment is unloaded. In the alternative, the sleeves of a short sleeve garment are placed onto the sleeve gripping members by inserting an end of each sleeve into the respective sleeve gripping member. The respective end of each short sleeve is then gripped by the respective sleeve gripping member. The pair of retractable arms are extended away from the buck into a finishing position. Heated air and steam flow through the short sleeve garment during the finishing operation. To unload the short sleeve garment, the end of the respective short sleeve is released from the respective sleeve gripping member and the short sleeve garment is unloaded.

It is yet another feature of the present invention to provide a method for finishing a pair of sleeves on a garment of different sizes and sleeve lengths. The method comprising, providing a buck in a pressing system for receiving the garment to be pressed with a pair of retractable arms positioned on opposing sides of the buck. In addition, a sleeve gripping member is provided on each of the retractable arms. The garment to be pressed is mounted onto the buck. An end of each long sleeve of a long sleeve garment is mounted onto a cuff mounting member positioned on the respective sleeve gripping member. A pair of clamping members positioned on each of the sleeve gripping members contract against the respective end of each long sleeve to hold the long sleeve of the garment in the appropriate position. The pair of retractable arms are extended away from the buck to a finishing position. Heated air and steam flow through the long sleeve garment during a finishing operation. To unload the long sleeve garment, the respective pair of clamping members move away from the end of the respective long sleeve to allow the long sleeve garment to be removed from the pressing system. In the alternative, the sleeves of a short sleeve garment are mounted onto a pair of sleeve engagement bars positioned on each of the sleeve gripping members. The respective pair of sleeve engagement bars expand within the respective end of each short sleeve to hold the short sleeve in the appropriate position. The pair of retractable arms are extended away from the buck into a finishing position. Heated air and steam flow through the short sleeve garment during the finishing operation. To unload the short sleeve garment, the pair of sleeve engagement bars on each retractable arm contract towards one another to allow the end of each short sleeve to be released from the pressing system and thereby allow the short sleeve garment to be unloaded from the pressing system.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

In accordance with a preferred embodiment of the present invention, a pair of mounting devices, one right and one left, are used on a shirt finishing machine to hold the outer ends of the sleeves of the shirt while the sleeves are being finished with hot air and/or steam. Each mounting device consists of clamps operated by a pneumatic cylinder which are retracted to hold long sleeves at the proper angle to the body of the shirt so as not to produce wrinkles in the sleeve. The same clamping mechanism is extended to expand a pair of rods which hold the sleeves of a short-sleeved shirt at a different angle in relation to the body of the shirt. This is an advantage over the prior art in that prior art devices used the same angle for both short and long sleeves or had complicated adjustable arms which were moved into position using manual clamps or pneumatic cylinders and controls. The sleeves are extended out from the body and are held by the sleeve clamps until the end of the finishing cycle when they are released from the sleeve clamps by removing pressure from the pneumatic cylinder. This allows the operator to remove the shirt from the form without releasing the clamps manually.

Figure 1:
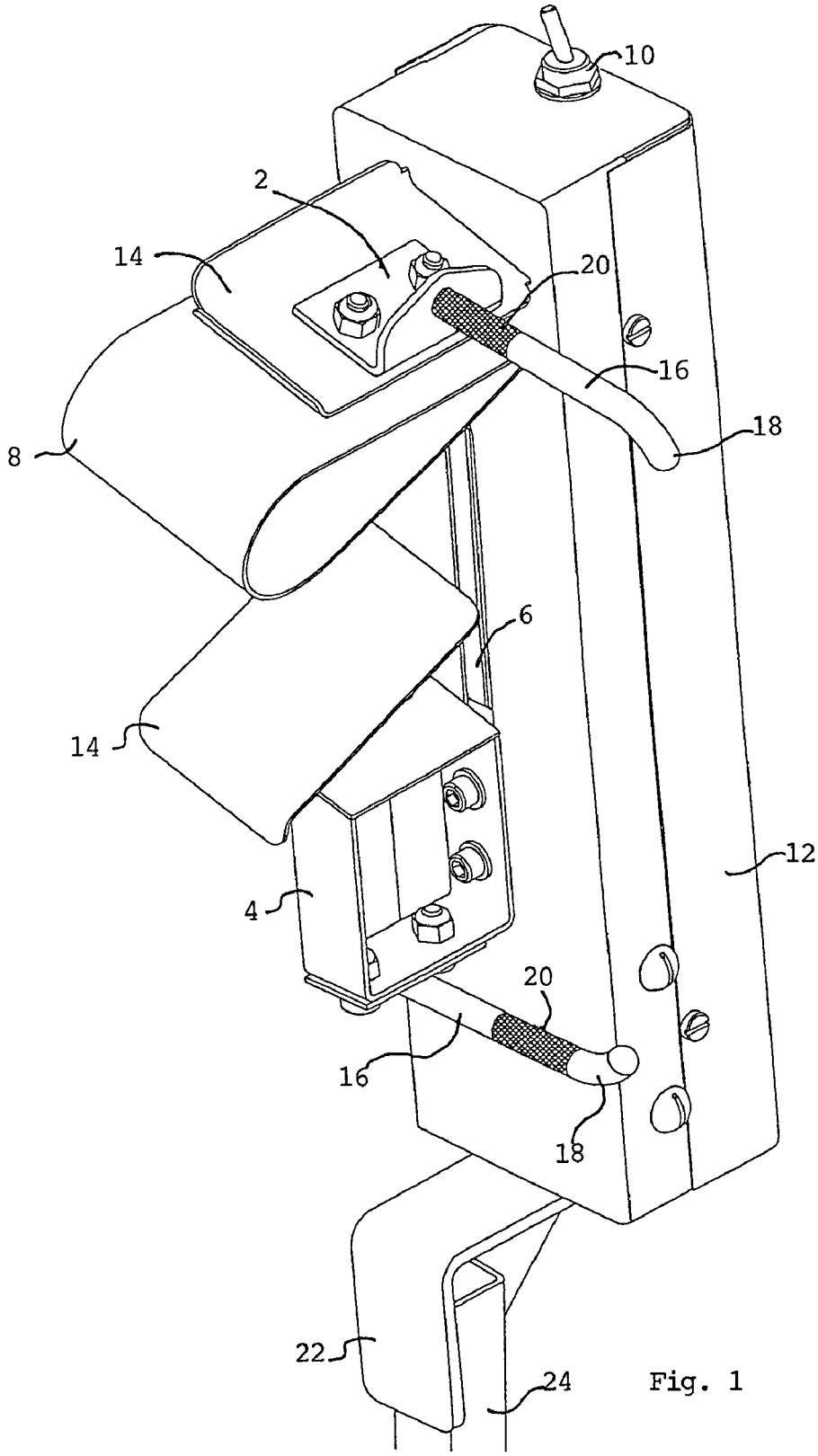
FIG. 1 is a pictorial representation of a cuff clamp constructed in accordance with a preferred embodiment having the clamp in the open position.
Figure 2:
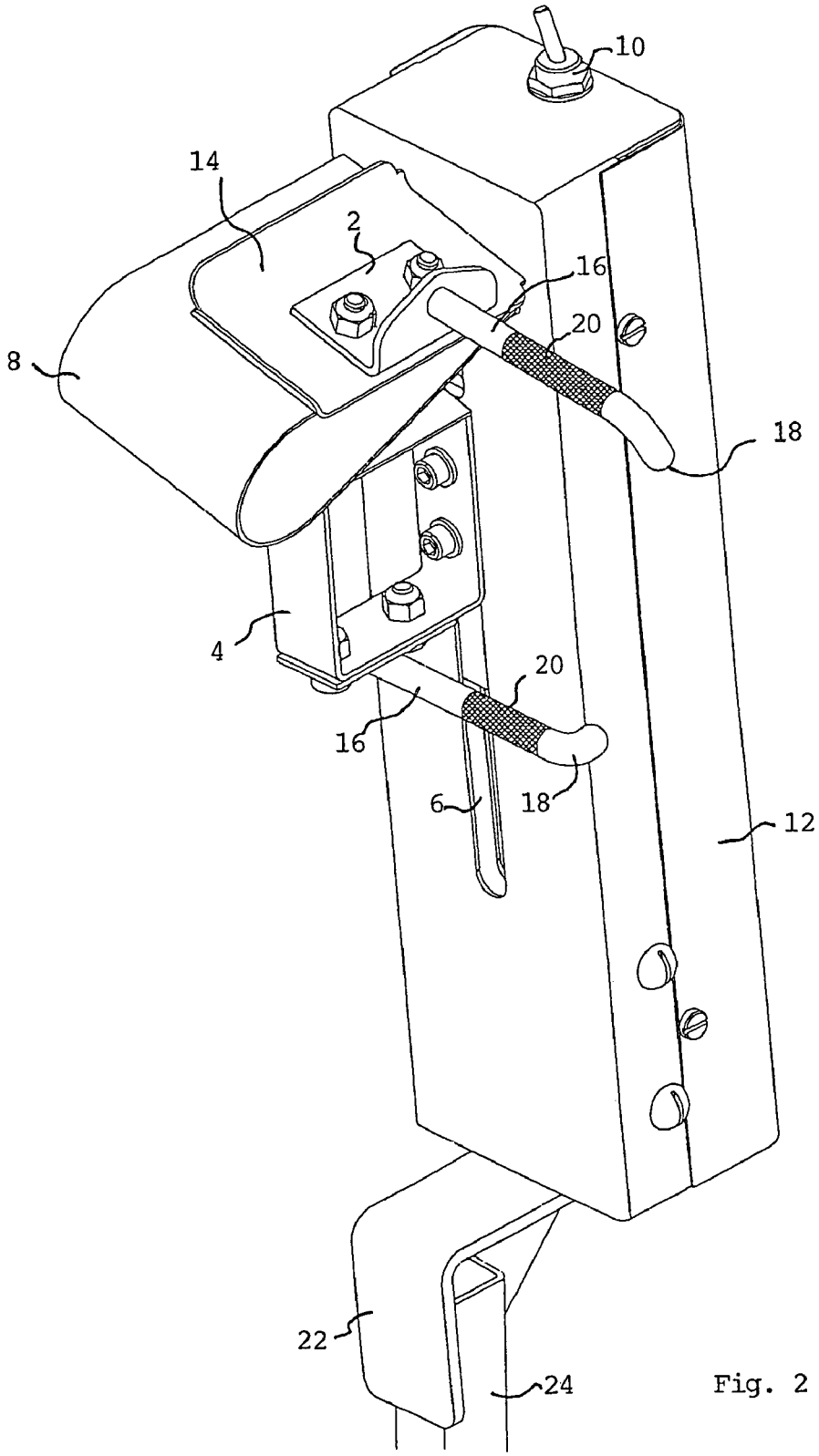
FIG. 2 is a pictorial representation of a cuff clamp constructed in accordance with a preferred embodiment having the clamp in the closed position.

Referring now to FIG. 1, an improved sleeve mounting device for receiving and holding the sleeves of a shirt that is constructed in accordance with a preferred embodiment of the present invention is shown. On this type of device, the body of the shirt is finished simultaneously with the use of pressing irons and/or hot air and steam. The sleeve mounting device has upper 2 and lower 4 clamping members. The upper 2 and lower 4 clamping members can be vertically displaced along a channel 6. In a preferred embodiment, cuff plates 14 are provided adjoining to said upper 2 and lower 4 clamping members along channel 6 to assist in gripping the long sleeves of long sleeve garments. Sleeve engagement bars 16 are mounted on each of the upper 2 and lower 4 clamping members. The sleeve engagement bars 16 have curved end portions 18 that facilitate reception of the short sleeves of a short sleeve garment and textured surfaces 20 that help grip the short sleeves once they have been received by the sleeve engagement bars 16. A cuff mounting member 8 is positioned along the vertical channel 6 between the upper 2 and lower 4 clamping members. The upper 2 and lower 4 clamping members can be moved upward or downward along the vertical channel 6 by a pneumatic cylinder (not shown) contained in housing 12 that is controlled by switch 10. When the switch 10 is placed in a first position, the lower 2 and upper 4 clamping members are moved by the pneumatic cylinder to a fully open position such as shown in FIG. 1. When the switch 10 is placed in a second position, the lower 2 and upper 4 clamping members move the cuff plates 14 against the cuff mounting member 8 such that the cuff mounting member 8 is clamped between the upper 2 and lower 4 clamping members as shown in FIG. 2. The movement of the lower 2 and upper 4 clamping members can be controlled by a pneumatic cylinder. The housing 12 preferably has an attachment member 22 that connects the device to the mounting arm 24 of a pressing machine.

The mounting device of FIGS. 1 and 2 allows a pressing machine to easily grasp either a short-sleeved or long-sleeved garment. Long sleeves are clamped by placing the cuff of the sleeve over the center form 8 or cuff mount 8 while the upper 2 and lower 4 clamping members are in an open or expanded position This center form 8 is shaped like a tear drop to properly hold the shape of the cuff during the finishing process. The unique tear drop shape also holds the opening at the gusset of the sleeve close together to eliminate excessive loss of steam and hot air which are used to finish the sleeve. Forcing sleeve air through the smaller opening at the gusset also aids in drying the multiple layers of material which form the gusset. The tear drop shaped piece 8 preferably has a fabric cover to stop steam and air from escaping out the end of the sleeve. With the cuff in place, the tear drop shaped center form 8 is pushed upward against the upper clamping member to temporarily hold the cuff until the operator can activate the pneumatic toggle valve to close the upper 2 and lower 4 clamping members. An alternate method of closing the upper 2 and lower 4 clamping members would incorporate a solenoid operated pneumatic or hydraulic valve to close or contract the upper 2 and lower 4 clamping members which could be activated by means of a foot switch or hand operated switch 10 or valve. When the upper 2 and lower 4 clamping members are closed, they apply pressure to hold the cuff against the tear drop shaped center form 8. The upper 2 and lower 4 clamping members can be covered with a soft foam and/or fabric to eliminate marks in the cuff. If cuff plates 14 are present, then a soft foam and/or fabric can be placed over the cuff plates 14 to eliminate marks in the cuff. Whereas, the prior art devices used a mechanical clip to hold the cuff over a round form which leaves an undesirable wrinkle or mark on the cuff. The long-sleeved shirt may be easily released from the device of FIGS. 1 and 2 by opening the upper 2 and lower 4 clamping members and sliding the cuff off of the center form 8. Therefore, a long sleeve shirt can be easily mounted on and removed from the mounting device of FIGS. 1 and 2 by simply opening the upper 2 and lower 4 clamping members, placing the cuff of the long sleeve shirt on the mounting member 8, closing the upper 2 and lower 4 clamping members around the cuff and then opening the upper 2 and lower 4 clamping members to release the long sleeve shirt. Since automated pressing machines are typically used in high volume applications, reducing the amount of time required to load or unload a shirt onto the pressing machine by even a small amount represents a substantial improvement upon the prior art.

Short-sleeved shirts are placed on the mounting device of FIG. 1 with the upper 2 and lower 4 clamping members in a contracted position. Thus, a short-sleeved shirt is mounted on the device of FIGS. 1 and 2 by activating the switch 10 such that the upper 2 and lower 4 clamping members are pressed against the cuff mounting member 8. The open end of the short sleeve shirt is placed over the sleeve engagement bars 16 and the operator activates the pneumatic toggle valve 10 to expand the upper 2 and lower 4 clamping members to thereby expand the sleeve engagement bars 16. The curved ends 18 of the sleeve engagement bars 16 help insure that the sleeve engagement bars 16 do not snag the sleeve of the short-sleeved shirt. The separating or expanding of the upper 2 and lower 4 clamping members stretches the sleeve of the short-sleeved shirt between the sleeve engagement bars 16. The sleeve of the short-sleeved shirt is held in place by a combination of tension on the sleeve engagement bars 16 and a unique textured tube 20 which is allowed to rotate on each sleeve engagement bar 16. The rough finish on the tube 20 holds the sleeve of the short-sleeved shirt to eliminate slippage while allowing the operator to "roll" the sleeve on the bars for proper alignment. Prior art devices used rubber tubes or tubes with rubber rings to hold the sleeves. However, these tubes do not allow for adjustment of the sleeves' position after the sleeves are tensioned and the tubes are difficult to place the sleeve over when loading. The short-sleeved shirt is removed from the device by flipping the switch 10 to contract the sleeve engagement bars 16 and release the sleeve of the short-sleeved shirt. Thus, the upper 2 and lower 4 clamping members and the sleeve engagement bars 16 allow the mounting device of FIGS. 1 and 2 to easily receive, hold and release a short-sleeved shirt.

Figure 3:
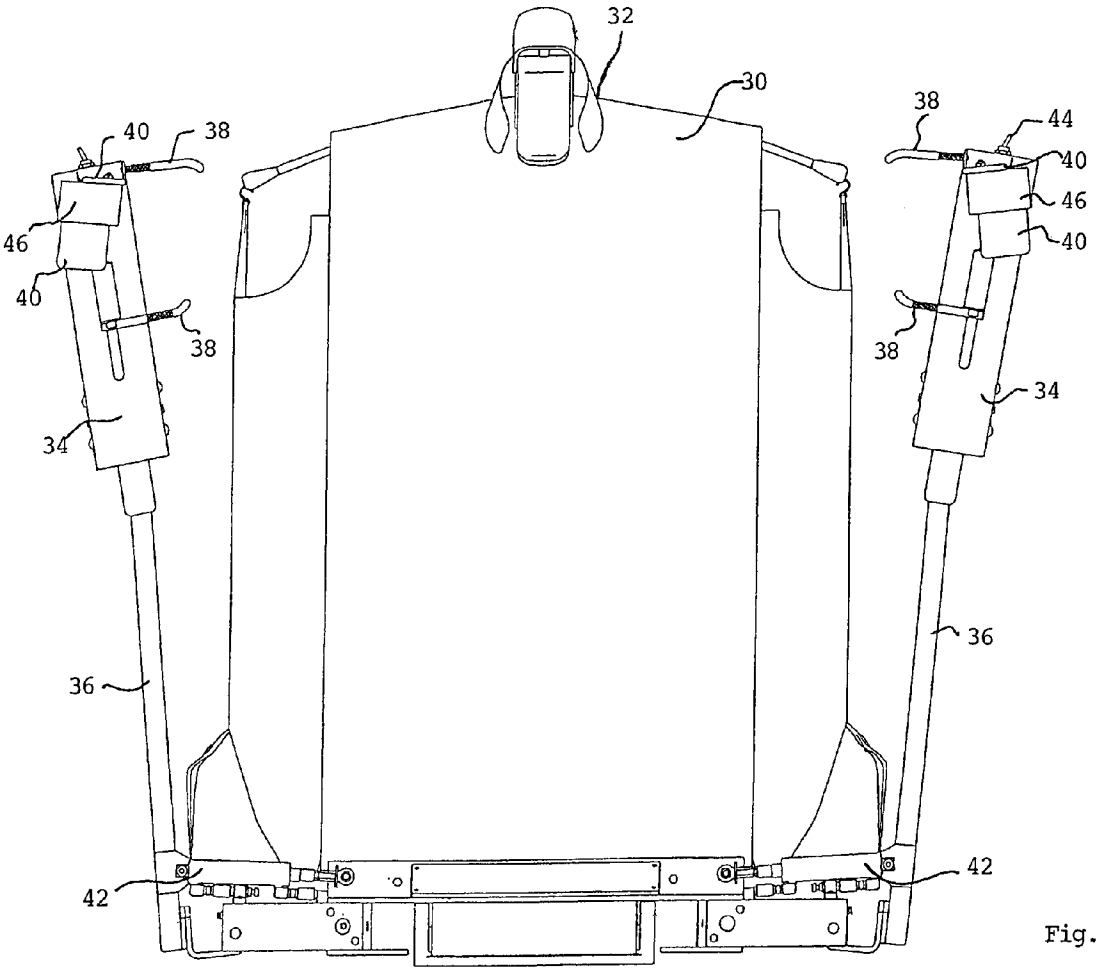
FIG. 3 is a front view of a pressing device constructed in accordance with a preferred embodiment of the present invention.

Referring now to FIG. 3, a preferred embodiment of a pressing apparatus constructed in accordance with the present invention is shown. The pressing apparatus has a buck 30 upon which the shirt to be pressed is placed. The collar of the shirt to be pressed is positioned around the collar mount 32. The cuffs of the shirt to be pressed are then received by the two sleeve gripping members 34 attached to the arms 36. The sleeve gripping members 34 are preferably constructed as set forth in FIGS. 1 and 2. Thus, each gripping member 34 has sleeve engagement bars 38 for receiving and holding the sleeves of short-sleeved shirts and clamping members 40 and cuff mounting member 46 for receiving and holding the cuffs of long-sleeved shirts. The arms 36 are attached to pneumatic cylinders 42 that allow them to be selectively extended to accommodate shirts of different sizes and sleeve lengths. In addition, the arms 36 may be retracted to decrease the cross sectional area of the pressing apparatus. The ability of the pressing apparatus of FIG. 3 to reduce its cross sectional area allows the pressing apparatus to be easily incorporated into a pressing device having multiple buck assemblies. In such a pressing device, one buck assembly, such as shown in FIG. 3, is rotated into a pressing position while the other mounting device is rotated into a loading position where it can receive the next article of clothing to be pressed. When the buck assembly is being rotated, the arms 36 are retracted by the cylinders 42 such that they are pulled in close to the buck 30 to prevent them from striking nearby personnel or machinery while rotating. Thus, the present invention allows a user to mount a shirt on the pressing device while a previously mounted shirt is being pressed.

Figure 4:
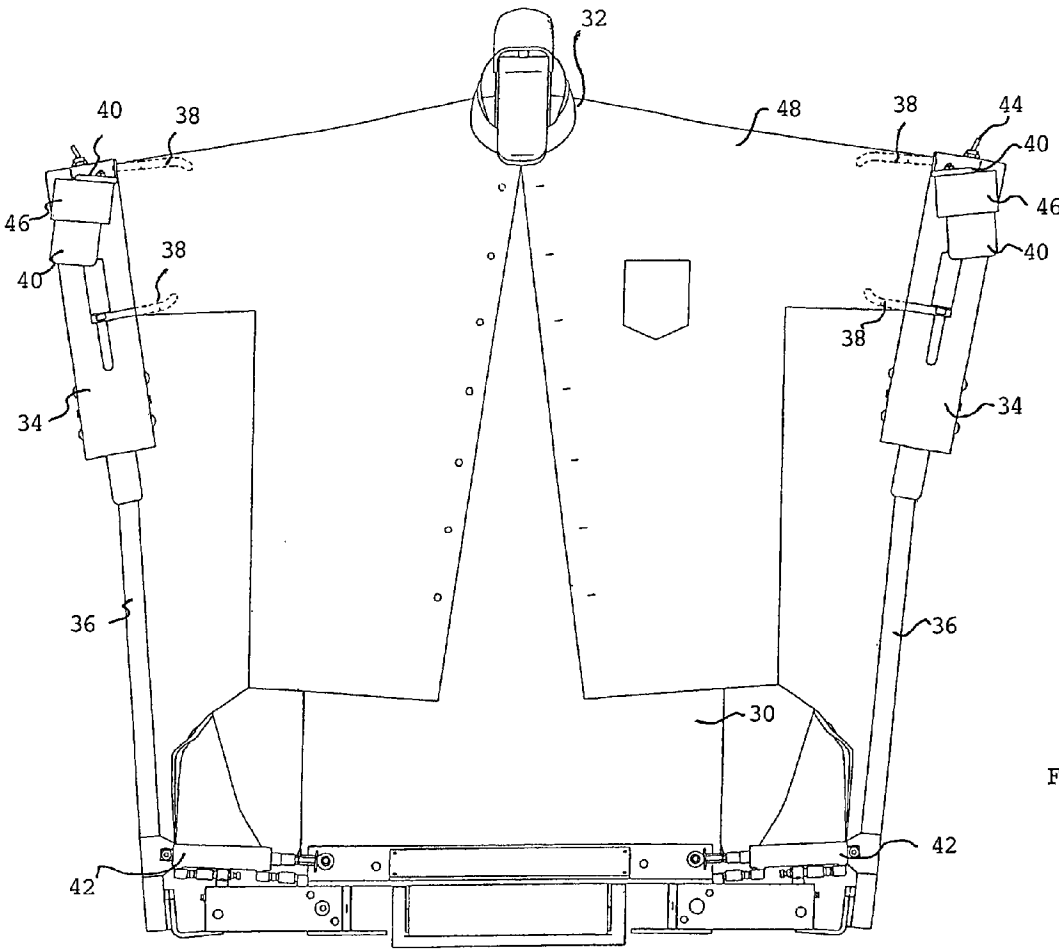
FIG. 4 is a front view of a pressing device constructed in accordance with a preferred embodiment of the present invention having a short-sleeved shirt mounted on the pressing device.

To mount a short-sleeved shirt on the pressing apparatus of FIG. 3, the shirt is placed over the mounting buck 30. The collar of the shirt is then positioned around the collar mount 32. The sleeve engagement bars 38 are moved closed together and the arms 36 pulled into the proper position to receive the sleeves of the shirt. The sleeves of the shirt are pulled over the engagement bars 38 and the switch 44 activated such that sleeve engagement bars 38 are forced into contact with the inner surfaces of the sleeve of the shirt. The arms 36 are then spread out to stretch the sleeves to their full extent to complete the dressing operation. In practice, the buck assembly would then rotate into a pressing position where a pair of pressing plates would press the shirt while another buck assembly would rotate into the loading position. FIG. 4 shows a short-sleeved shirt 48 properly mounted on the mounting station of FIG. 3.

Figure 5:
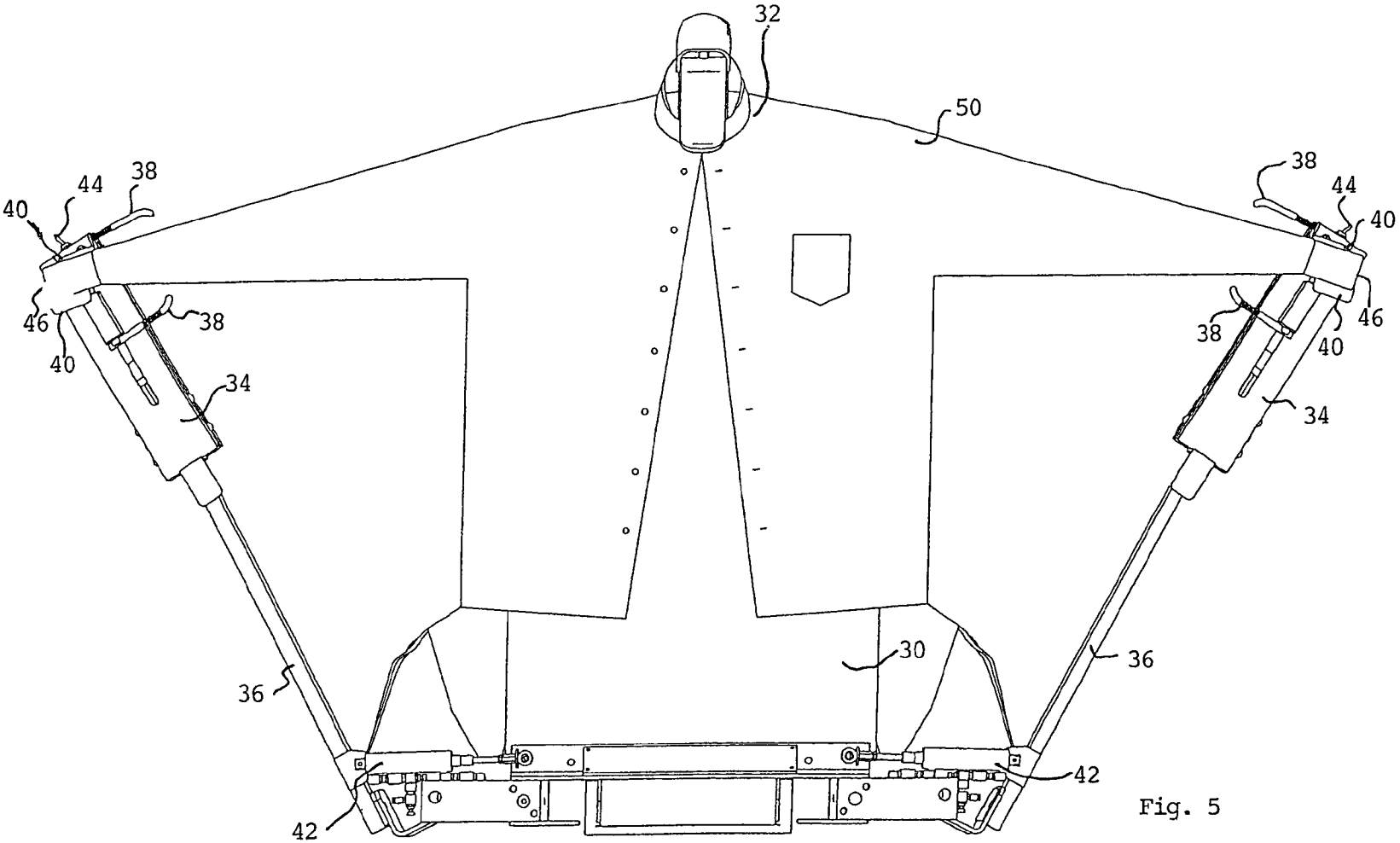
FIG. 5 is a front view of a pressing device constructed in accordance with a preferred embodiment of the present invention having a long-sleeved shirt mounted on the device.

A long-sleeved shirt 50 is mounted in a similar fashion. However, the operation of the switch 44 is reversed when mounting a long-sleeved shirt. Thus, the clamping members 40 are opened or expanded to allow the cuff of the shirt 50 to be placed around the cuff mounting member 46. Once the cuff has been positioned around the cuff mounting member 46, the clamping members 40 are closed or contracted such that the cuffs of the sleeves of the long-sleeved shirt 50 are gripped between the clamping members 40 and the cuff mounting member 46. The arms 36 are then spread out such that the sleeves of the long-sleeved shirt are stretched into position for pressing. FIG. 5 shows a long-sleeved shirt 50 mounted on the mounting station of FIG. 3. Thus, the sleeve engagement bars 38 and clamping members 40 allow the pressing apparatus of FIG. 3 to receive both cuffed and un-cuffed shirts while the retractable arms 36 allow the pressing apparatus to accommodate shirts having sleeves of any length. In addition, the arms 36 may be retracted toward the mounting device 30 such that the buck assembly of FIG. 3 can be rotated into a pressing position without the retractable arms 36 striking other parts of the pressing machinery.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A method for finishing a pair of sleeves on a garment comprising:

providing a buck for receiving the garment to be pressed;

providing a pair of retractable arms positioned on opposing sides of the buck;

providing a pair of sleeve gripping members mounted on each of said retractable arms;

mounting the garment to be pressed onto the buck;

mounting an end of each long sleeve of a long sleeve garment onto a cuff mounting member positioned on each of said sleeve gripping members;

contracting a pair of clamping members positioned on each of said sleeve gripping members against the end of each long sleeve;

extending said pair of retractable arms away from said buck;

flowing heated air and steam through the long sleeve garment during a finishing operation;

extending said pair of clamping members away from the end of each long sleeve to unload the long sleeve garment;

mounting an end of each short sleeve of a short sleeve garment onto a pair of sleeve engagement bars positioned on each of said sleeve gripping members;

expanding each of said pair of sleeve engagement bars within the end of each short sleeve;

extending said pair of retractable arms away from said buck;

flowing heated air and steam through the short sleeve garment during the finishing operation; and contracting said pair of sleeve engagement bars away from the end of each short sleeve to unload the short sleeve garment.

2. The method of claim 1, further comprising:

providing at least one pneumatic valve to operate said pair of retractable arms, said clamping members and said sleeve engagement bars.

* * * * *